US007364492B2

(12) United States Patent
Honda et al.

(10) Patent No.: US 7,364,492 B2
(45) Date of Patent: Apr. 29, 2008

(54) ON-LINE GRINDING METHOD FOR WORK ROLL

(75) Inventors: Takayuki Honda, Oita (JP); Masaki Kobayashi, Oita (JP); Tetsuya Nakano, Oita (JP); Akihiro Yamamoto, Hiroshima (JP); Shinichi Kaga, Tokyo (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 0 days.

(21) Appl. No.: 10/578,829

(22) PCT Filed: Dec. 1, 2005

(86) PCT No.: PCT/JP2005/022052

§ 371 (c)(1),
(2), (4) Date: May 10, 2006

(87) PCT Pub. No.: WO2006/059667

PCT Pub. Date: Jun. 8, 2006

(65) Prior Publication Data

US 2007/0082585 A1 Apr. 12, 2007

(30) Foreign Application Priority Data

Dec. 2, 2004 (JP) ..... 2004-349425

(51) Int. Cl.
*B24B 5/04* (2006.01)

(52) U.S. Cl. ..... 451/5; 451/49

(58) Field of Classification Search ..... 451/11, 451/10, 5, 49, 14, 19
See application file for complete search history.

(56) References Cited

U.S. PATENT DOCUMENTS 3,690,072 A * 9/1972 Price ..... 451/9
3,691,701 A * 9/1972 Clark et al. ..... 451/408

FOREIGN PATENT DOCUMENTS

| | | | |
|---|---|---|---|
| CN | 1145288 | A | 3/1997 |
| JP | 5-337521 | A | 12/1993 |
| JP | 8-300015 | A | 11/1996 |
| JP | 8-309411 | A | 11/1996 |
| JP | 9-164407 | A | 6/1997 |

OTHER PUBLICATIONS

Chinese Office Action for Application No. 200580001799.5 issued Sep. 14, 2007.

* cited by examiner

*Primary Examiner*—Robert Rose
(74) *Attorney, Agent, or Firm*—Birch, Stewart, Kolasch & Birch, LLP

(57) ABSTRACT

An on-line roll grinding method for a work roll, which can decrease an overshoot, by which the pressing load of a rotating grinding wheel on a work roll exceeds a set grinding pressing load, is provided. This method is an on-line grinding method for a work roll, adapted to press a rotating grinding wheel (3*a*) having elasticity against a work roll (1) of a rolling mill to grind the work roll, wherein when the pressing load of the rotating grinding wheel (3*a*) reaches a set load F, which has been set beforehand, after the rotating grinding wheel (3*a*) contacts the work roll (1), the forward velocity of the rotating grinding wheel (3*a*) is reduced to decrease an overshoot by which the pressing load of the rotating grinding wheel (3*a*) on the work roll (1) exceeds a set grinding pressing load $F_0$.

3 Claims, 2 Drawing Sheets

ON-LINE GRINDING METHOD FOR WORK ROLL

TECHNICAL FIELD

This invention relates to an on-line grinding method for grinding a work roll during the operation of a rolling mill.

BACKGROUND ART

An on-line roll grinding apparatus grinds a work roll (may hereinafter be referred to as a roll) during the operation of a rolling mill to eliminate irregularities on the surface of the work roll occurring upon rolling, thereby increasing the volume of production (roll units) achievable by rolling with a single roll. Such an on-line roll grinding apparatus has so far been used, for example, in a finishing mill in the continuous hot rolling process (HOT).

That is, when the work roll of a plate rolling mill rolls a steel plate, only portions of the work roll in contact with the steel plate wear, and wear steps appear between the worn-out portions and non-rolling portions out of contact with the steel plate. If the roll with such wear steps is used to roll a steel plate having a width equal to or larger than the widths of the wears, the problem of deteriorating the accuracy of the plate thickness or the flatness has arisen.

This has necessitated restrictions on a rolling schedule, such as the rolling of plates in the order of decreasing width. However, the installation of an on-line roll grinding apparatus enables the wear steps, which increase with the progress of rolling, to be sequentially ground and removed. Thus, the above restrictions can be abolished to increase the roll units.

With the on-line roll grinding apparatus, in order to avoid damage to a rotating grinding wheel (may hereinafter be referred to as a grinding wheel) or failure of the grinding apparatus, wear steps of the non-rolling portions have to be ground and removed within a limited period of time which is other than the instant of biting, into the rolling mill, of a material to be rolled, and the instant of release of the rolled material from the rolling mill.

In order to grind and remove the wear steps efficiently, therefore, it is necessary to use a grinding wheel having a high grinding ability, and ensure as long an actual grinding time as possible.

In order that the grinding wheel is not damaged upon contact of the roll and the grinding wheel due to vibrations caused by impact at the time of biting, into the rolling mill, of the material to be rolled and release of the material from the rolling mill, the grinding wheel, when not in a grinding operation, is on standby 10 mm to 20 mm away from the roll surface.

If the timing is right for start of grinding, the grinding wheel begins to move forward, and touches the roll. Then, when a grinding pressing load which has been set beforehand is reached, grinding is started. To ensure a long actual grinding time, a grinding preparation time from the start of forward movement of the grinding wheel until the above set grinding pressing load is reached needs to be shortened. That is, the velocity of the forward movement (i.e., forward velocity) of the grinding wheel needs to be rendered high.

The grinding ability of the grinding wheel varies with its pressing load on the roll. During grinding, therefore, it is necessary to detect the pressing load by a built-in load cell, and control the pressing amount of the grinding wheel, thereby controlling the pressing load. The structure of the grinding apparatus, and the basic method of its control are disclosed, for example, in Patent Document 1.

This method, basically, comprises grinding under a certain pressing load to a certain depth in order to maintain the profile of the roll. If the profile is to be changed intentionally, the pressing load is varied according to the site of the roll to control the grinding depth.

However, this conventional method has posed the problem that if the grinding wheel is moved forward at a high velocity at the start of grinding, the pressing load increases rapidly to greatly exceed the set value of the grinding pressing load, thereby causing excessive grinding or, in some cases, damaging the grinding wheel.

Particularly, in the conventional on-line grinding in the rolling mill for the continuous hot rolling process, grinding was performed during biting of the material to be rolled, which lasted for a relatively long time of 60 seconds to 120 seconds. Because of this ample grinding time, the necessity for shortening the grinding preparation time was minimal. Thus, priority was placed on preventing excessive grinding or damage to the grinding wheel, and the adopted method was to move the grinding wheel forward from the standby position at a low velocity and bring the grinding wheel into touch with the roll.

In rolling a thick plate with a plate thickness of 6 mm or more, however, intermittent rolling by one or two rolling mills is performed. Thus, the rolling time, during which the material to be rolled is bitten and rolled, is of the order of 10 seconds at the longest. With this period of time, roll grinding cannot be completed at a stroke. The timing with which grinding can take place is at the time of a turn when the direction of rolling of the steel plate is changed, or at idle.

The state "at idle" refers to a state in which after rolling of a preceding material to be rolled has been completed, the roll is idling while waiting for biting of a succeeding material to be rolled, the state lasting for a short time of about 20 seconds.

Under these circumstances, it was necessary to actualize an on-line roll grinding method for ensuring as long a roll grinding time as possible, and decreasing an overshoot, by which the pressing load of the grinding wheel on the work roll exceeds the set grinding pressing load, thereby preventing excessive grinding or damage to the grinding wheel.

Patent Document 1: Japanese Patent Application Laid-Open No. 1996-30941.1

DISCLOSURE OF THE INVENTION

Problems to be Solved by the Invention

Therefore, it is an object of the present invention to provide an on-line roll grinding method for a work roll, which minimizes the aforementioned grinding preparation time for the rotating grinding wheel and can decrease an overshoot, by which the pressing load of the grinding wheel on the work roll exceeds the set grinding pressing load.

Means for Solving the Problems

The present invention has been accomplished in an attempt to attain the above object. Its means reside in the following:

(1) An on-line grinding method for a work roll, adapted to press a rotating grinding wheel having elasticity against a work roll of a rolling mill to grind the work roll, characterized in that when the pressing load of the rotating grinding wheel reaches a set load F, which has been set beforehand, after the rotating grinding wheel contacts the work roll, the forward velocity of the rotating grinding wheel is reduced to decrease an overshoot by which the pressing load F of the rotating grinding wheel on the work roll exceeds a set grinding pressing load $F_0$.

(2) The on-line grinding method for a work roll according to the means (1), characterized in that the load F which has been set beforehand has a value in a range satisfying the following equation (A):

$$F \leqq F_0 - K \times V1 \times \Delta t \quad (A)$$

where

F: set load [N], $F_0$: set grinding pressing load [N],

K: grinding wheel spring rigidity [N/mm],

V1: forward velocity [mm/s] of grinding wheel before velocity reduction, and Δt: control delay time [s].

(3) The on-line grinding method for a work roll according to the means (1) or (2), characterized in that the forward velocity V2 of the rotating grinding wheel after velocity reduction satisfies the following equation (B):

$$0.6 \times (S \times F_0/(K \times \Delta t)) \leqq V2 \leqq S \times F_0/(K \times \Delta t) \quad (B)$$

where

V2: forward velocity [mm/s] of rotating grinding wheel after velocity reduction, S: ratio of allowable overshoot amount to set grinding pressing load $F_0$, K: grinding wheel spring rigidity [N/mm], and Δt: control delay time [s].

EFFECTS OF THE INVENTION

According to the present invention, at a stage where the rotating grinding wheel having elasticity contacts the work roll, and reaches the set load F which has been set beforehand, the forward velocity of the rotating grinding wheel is reduced to decrease the amount,of overshoot, by which the pressing load of the rotating grinding wheel on the work roll exceeds the set grinding pressing load, thereby enabling the overshoot to be confined within the allowable value. Thus, industrially useful remarkable effects are obtained, such that the excessive grinding of the work roll and damage to the rotating grinding wheel can be prevented.

DESCRIPTION OF THE NUMERALS

1 Work roll

2 Backup roll

3 Roll grinding apparatus

Best Mode for Carrying Out the Invention

The best mode for carrying out the present invention will be described in detail using FIGS. 1 to 4.

In the present embodiment, a steel plate, as a representative example of a material to be rolled, will be described.

Figure 1:
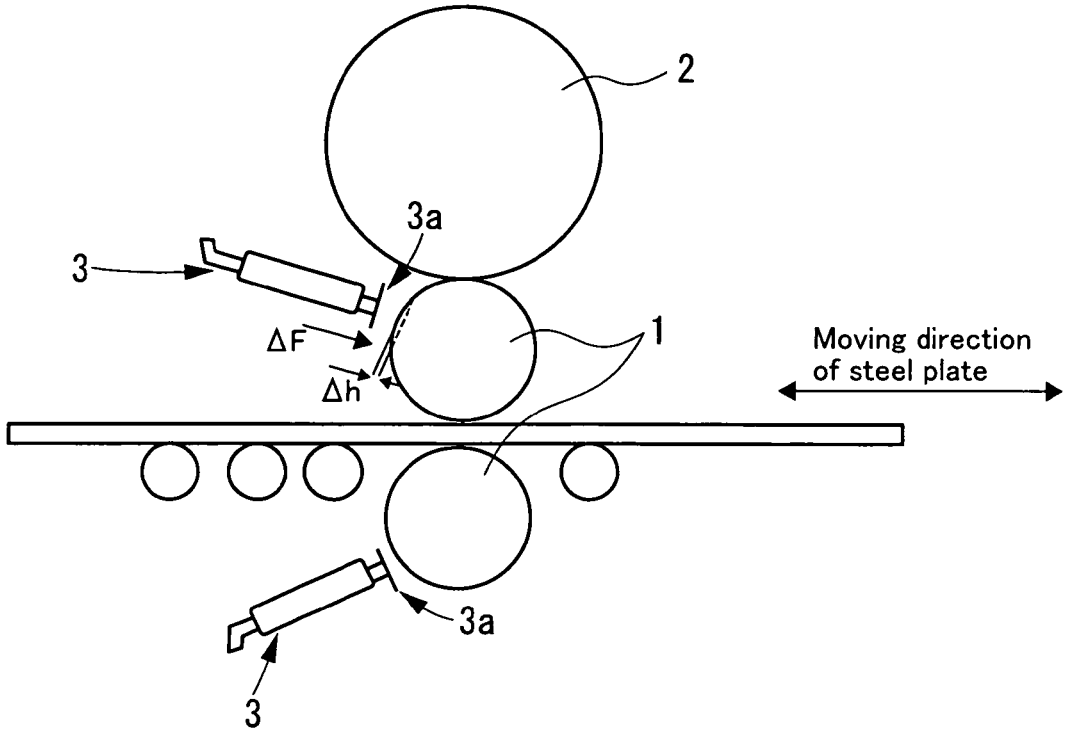
FIG. 1 is a view illustrating an embodiment of the on-line roll grinding method according to the present invention, as a sectional view of a rolling mill viewed from its side surface.

FIG. 1 is a view illustrating an embodiment of the on-line grinding method according to the present invention.

In FIG. 1, 1 denotes a work roll, 2 denotes a backup roll, and 3 denotes a roll grinding apparatus.

In the present embodiment, a pair of (i.e., right and left) roll grinding apparatuses 3 are provided for each of upper and lower work rolls 1; namely, total four of the roll grinding apparatuses 3 are provided. As shown in FIG. 1, the roll grinding apparatus 3 is moved in the axial direction of the roll, with a rotating grinding wheel 3*a* being pressed against the surface of the work roll 1, whereby the surface of the work roll 1 can be ground.

As shown in FIG. 1, if the rotating grinding wheel 3*a* is pressed against the roll to cause a grinding wheel deflection amount change of Δh, the pressing load of the grinding wheel is changed by ΔF.

Figure 2:
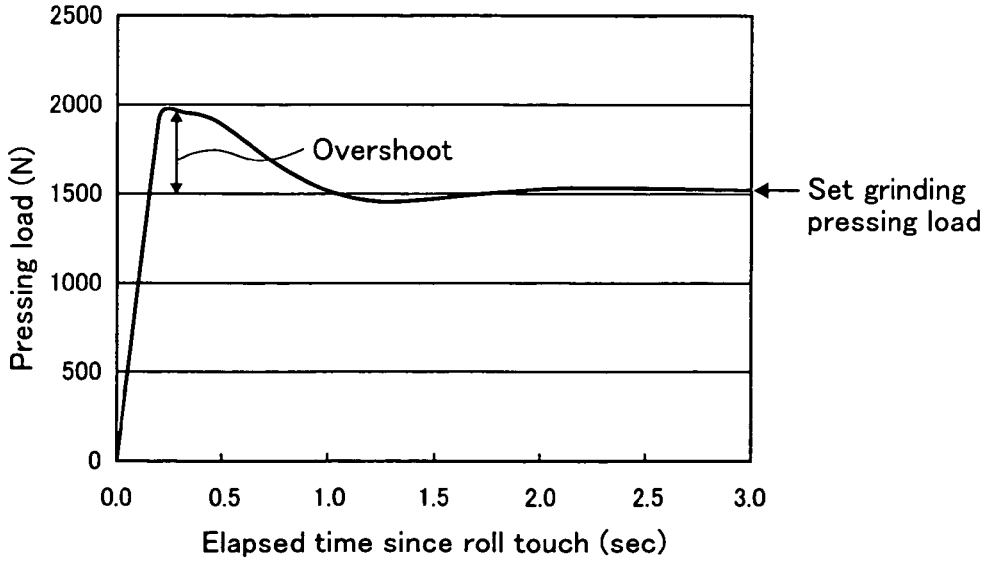
FIG. 2 is a view illustrating an overshoot in a conventional on-line roll grinding method.

FIG. 2 is a view illustrating changes in the pressing load of the rotating grinding wheel in the conventional on-line roll grinding method when the forward velocity of the rotating grinding wheel is high. If the rotating grinding wheel is moved forward at a high velocity even after contact of the rotating grinding wheel with the work roll, the aforementioned grinding preparation time becomes short. However, the pressing load sharply increases and, because of a delay in the feedback control of the pressing load, the pressing load exceeds $F_0$, which is a set grinding pressing load, to generate an overshoot beyond an allowable value. This presents the cause of excessive grinding or damage to the rotating grinding wheel.

Figure 3:
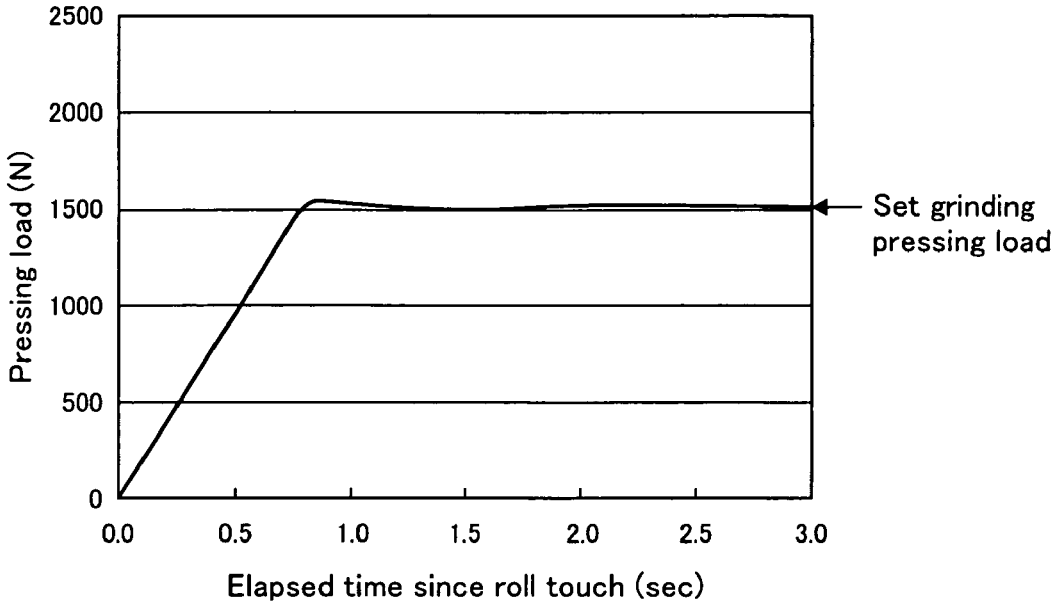
FIG. 3 is a view illustrating changes in the pressing load of a rotating grinding wheel in the conventional on-line roll grinding method when the forward velocity of the rotating grinding wheel is low.

FIG. 3 is a view illustrating changes in the pressing load of the rotating grinding wheel when the forward velocity of the rotating grinding wheel is low. If the forward velocity of the rotating grinding wheel is set to be low, an overshoot beyond the allowable value, as mentioned above, does not occur. However, a long grinding preparation time is taken until the set grinding pressing load $F_0$ is reached. Thus, a long grinding time is required for performing predetermined grinding.

Under these circumstances, the inventors have conducted studies on a method by which the set grinding pressing load $F_0$ is reached in a short time, with an overshoot beyond the allowable value being avoided, even if there is a delay in the feedback control of the pressing load.

Let the grinding wheel spring rigidity of the rotating grinding wheel be K [N/mm], and the pressing amount (deflection amount) change of the grinding wheel be Δh [mm]. Then, the pressing load change ΔF [N] shown in FIG. 1 will be $$\Delta F = K \times \Delta h \quad (1)$$

Let the forward velocity of the rotating grinding wheel during its forward movement from its standby position for its touch with the work roll be V1 [mm/s]. Then, assuming that the elapsed time since the rotating grinding wheel touched the work roll is Δt [s], the pressing amount change Δh [mm] of the rotating grinding wheel is expressed as $$\Delta h = V1 \times \Delta t \quad (2)$$

Thus, the change in the pressing load after the touch with the work roll will be $$\Delta F = K \times V1 \times \Delta t \quad (3)$$

Thus, the higher the rigidity of the rotating grinding wheel, or the higher the forward velocity, the shorter time is taken for an increase in the pressing load. Moreover, the higher the forward velocity, the greater overshoot occurs because of a longer delay in control.

As will be seen from the equation (3), a sharp increase in the pressing load can be curbed by rendering the rigidity of the rotating grinding wheel low. However, in order that the rotating grinding wheel is not plastically deformed under the pressing load imposed by grinding, the rigidity of the rotating grinding wheel is limited by the pressing load necessary for the grinding ability.

Delay in control is caused by the sampling time for load detection, the control characteristics of the motor, and so on. Thus, in order to avoid an excessive load even upon high velocity forward movement of the rotating grinding wheel, there is need to reduce the forward velocity before the pressing load after touch with the work roll reaches the set grinding pressing load $F_0$, for the purpose of compensating from the delay in control. If the delay time Δ in control is known, an overshoot beyond the allowable value is prevented in consideration of this delay time. For this purpose, a set load F at a point in time, at which the forward velocity of the rotating grinding wheel is changed, may take on a value as shown in the equation (4):

$$F \leqq F_0 - K \times V1 \times \Delta t \quad (4)$$

However, the grinding wheel spring rigidity K of the rotating grinding wheel is generally 1,000 N/mm to 3,000 N/mm. Thus, when the rotating grinding wheel is pressed against the work roll at a forward velocity of 5 mm/s, a load change of 50 N to 150 N occurs at each sampling, provided that the sampling time for load detection is 10 msec. This load change is relatively large, if it is considered that the set grinding pressing load $F_0$ of the grinding wheel is generally 500 N to 2,000 N. In order to prevent an overshoot beyond the allowable value reliably, therefore, it is preferred to set load such that the forward velocity of the rotating grinding wheel is reduced before the set load F shown by the above equation (4) is exceeded.

The rotating grinding wheel after velocity reduction moves forward at that velocity V2 after velocity reduction, and stops upon detection of the set grinding pressing load $F_0$. On this occasion, the aforementioned delay in control occurs, and an overshoot beyond the allowable value is likely to occur. Thus, it is preferred to use a forward velocity which is within a range calculated from the following equation (5) in consideration of the control delay time Δt and the ratio S of the allowable overshoot amount to the set grinding pressing load $F_0$, and which is close to the upper limit:

$$0.6 \times (S \times F_0/(K \times \Delta t)) \leqq V2 \leqq S \times F_0/(K \times \Delta t) \quad (5)$$

The reason why the lower limit of the forward velocity V2 of the rotating grinding wheel after velocity reduction is set at $0.6 \times (S \times F_0/(K \times \Delta t))$ is that if V2 is less than this lower limit, an unnecessarily long time is taken until the set grinding pressing load $F_0$ is reached.

Figure 4:
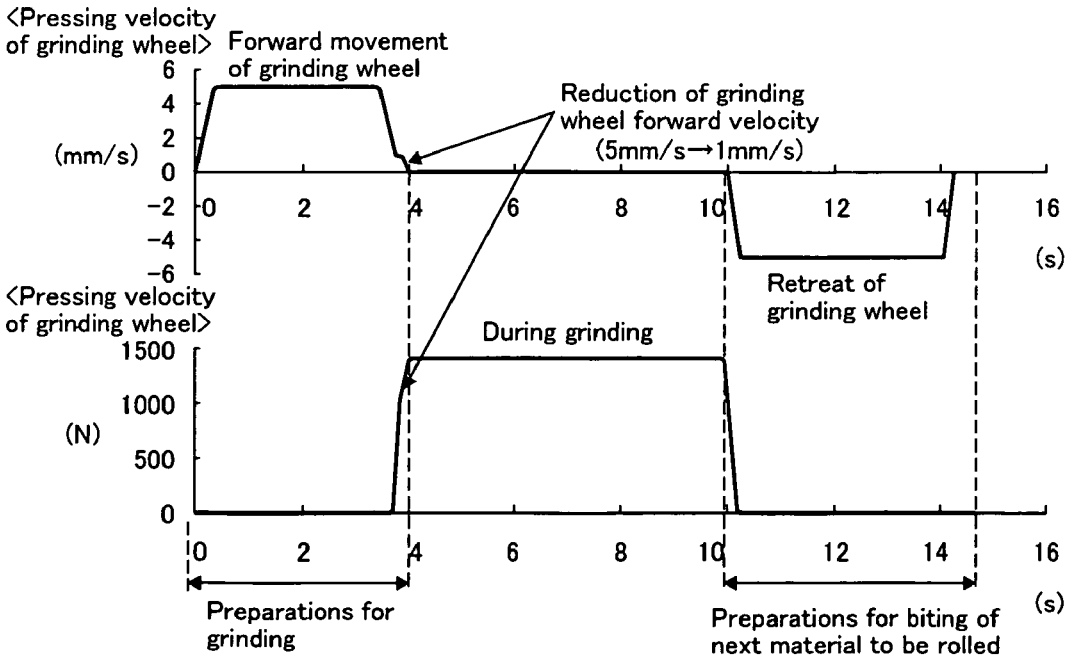
FIG. 4 is a view illustrating changes in a pressing rate and a pressing load in the on-line roll grinding method of the present invention.

As shown in FIG. 4, until the rotating grinding wheel contacts the work roll, the forward velocity of the rotating grinding wheel is set at 5 mm/s. After the rotating grinding wheel contacts the work roll and, for example, at a stage where the pressing load reaches 1,000 (N), the forward velocity of the rotating grinding wheel is reduced from 5 mm/s to 1 mm/s. By so doing, an overshoot by which the pressing load of the rotating grinding wheel on the work roll exceeds the set grinding pressing load $F_0$ (1,500 N) can be decreased to confine the amount of overshoot within the allowable overshoot range, and the time taken until the set grinding pressing load $F_0$ is reached (i.e., grinding preparation time) can be shortened.

EXAMPLES

Working examples of the on-line grinding method for a work roll according to the present invention will be shown in Table 1.

TABLE 1

| Classification | | Grinding wheel rigidity K [N/mm] | Set grinding pressing load $F_0$ [N/mm] | Pressing load at start of velocity reduction F [N/mm] Calculated value | Pressing load at start of velocity reduction F [N/mm] Set value | Forward velocity before velocity reduction V1 [m/s] | Forward velocity after velocity reduction V2 [m/s] Calculated value | Forward velocity after velocity reduction V2 [m/s] Measured value |
|---|---|---|---|---|---|---|---|---|
| Examples of | 1 | 1000 | 1500 | 1000 | 1000 | 5 | 0.9-1.5 | 1 |
| present | 2 | 2000 | 1500 | 500 | 400 | 5 | 0.42-0.7 | 0.5 |
| invention | 3 | 1000 | 1500 | 500 | 300 | 10 | 0.9-1.5 | 1 |
| Comparative | 1 | 1000 | 1500 | 1000 | 1100 | 5 | 0.9-1.5 | 1 |
| Examples | 2 | 1000 | 1500 | 1000 | 500 | 5 | 0.9-1.5 | 1.6 |
| Conventional | 1 | 1000 | 1500 | 1000 | — | 5 | 0.9-1.5 | 5 |
| Examples | 2 | 1000 | 1500 | 1000 | — | 1 | 0.9-1.5 | 1 |

| Classification | | Grinding preparation time [s] | Overshoot [N] Allowable value | Overshoot [N] Ratio | Overshoot [N] Measured value | Grinding depth [μm] Desired value | Grinding depth [μm] Measured value | Grinding wheel damage |
|---|---|---|---|---|---|---|---|---|
| Examples of | 1 | 3 | 150 | 0.1 | 30 | 3 | 3 | No |
| present | 2 | 3 | 150 | 0.1 | 0 | 3 | 3 | No |
| invention | 3 | 1.5 | 150 | 0.1 | 0 | 3 | 3 | No |
| Comparative | 1 | 3 | 150 | 0.1 | 120 | 3 | 3 | No |
| Examples | 2 | 3 | 150 | 0.1 | 80 | 3 | 3 | No |
| Conventional | 1 | 3 | 150 | 0.1 | 500 | 3 | 4 | Yes |
| Examples | 2 | 15 | 150 | 0.1 | 50 | 3 | 3 | No |

In Examples 1 to 3 of the present invention, the set load F, under which reduction of the forward velocity of the rotating grinding wheel started, satisfied the calculation equation (A) of claim 2, and the forward velocity after velocity reduction also satisfied the calculation equation (B) of claim 3. Thus, grinding was able to be started, with the grinding preparation time being short, little overshoot being present, and no damage to the rotating grinding wheel being caused.

Comparative Example 1 is a comparative example with respect to claim 2 of the present invention, and is an example in which the set load F, under which reduction of the forward velocity of the rotating grinding wheel started, did not satisfy the calculation equation (A) of claim 2 (the set load took on a value higher than the calculated value). In Comparative Example 1, the amount of overshoot was large, although it was within the allowable value.

Comparative Example 2 is a comparative example with respect to claim 3 of the present invention, and is an example in which the forward velocity V2 of the rotating grinding wheel after velocity reduction did not satisfy the calculation equation (B) of claim 3 (this velocity took on a value slightly higher than the calculated value) In Comparative Example 2, the amount of overshoot was large, although it was within the allowable value.

Conventional Example 1 is an example in which the forward velocity of the rotating grinding wheel was not reduced, but remained at 5 mm/s. In this example, the roll touch portion, where the overshoot amount can be kept within the allowable value, imposed excessive load, with the result that grinding took place to a depth larger than targeted. Moreover, the grinding wheel was deformed so greatly that cracks occurred.

Conventional Example 2 is an example in which the forward velocity of the rotating grinding wheel was kept at a low value of 1 mm/s from the beginning. No overshoot was caused, but the grinding preparation time was long.

INDUSTRIAL APPLICABILITY

The on-line grinding method for a work roll according to the present invention is preferred for use in the finishing mill of continuous hot rolling equipment.

The invention claimed is:

1. An on-line grinding method for a work roll, adapted to press a rotating grinding wheel having elasticity against a work roll of a rolling mill to grind the work roll, characterized in that when a pressing load of the rotating grinding wheel reaches a set load F, which has been set beforehand at a value which is lower than a set grinding pressing load $F_0$, after the rotating grinding wheel contacts the work roll, a forward velocity of the rotating grinding wheel is reduced to decrease an overshoot by which the pressing load of the rotating grinding wheel on the work roll exceeds the set grinding pressing load $F_0$, characterized in that the load F which has been set beforehand has a value in a range satisfying the following equation (A):

$$F \leqq F_0 - K \times V1 \times \Delta t \quad \text{(A)}$$

where

F: set load [N], $F_0$: set grinding pressing load [N],

K: grinding wheel spring rigidity [N/mm],

V1: forward velocity [mm/s] of grinding wheel before velocity reduction, and Δt: control delay time [s].

2. An on-line grinding method for a work roll, adapted to press a rotating grinding wheel having elasticity against a work roll of a rolling mill to grind the work roll, characterized in that when a pressing load of the rotating grinding wheel reaches a set load F, which has been set beforehand at a value which is lower than a set grinding pressing load $F_0$, after the rotating grinding wheel contacts the work roll, a forward velocity of the rotating grinding wheel is reduced to decrease an overshoot by which the pressing load of the rotating grinding wheel on the work roll exceeds the set grinding pressing load $F_0$, characterized in that a forward velocity V2 of the rotating grinding wheel after velocity reduction satisfies the following equation (B):

$$0.6 \times (S \times F_0/(K \times \Delta t)) \leqq V2 \leqq S \times F_0/(K \times \Delta t) \quad \text{(B)}$$

where

V2: forward velocity [mm/s] of rotating grinding wheel after velocity reduction, S: ratio of allowable overshoot amount to set grinding pressing load $F_0$, K: grinding wheel spring rigidity [N/mm], and Δt: control delay time [s].

3. An on-line grinding method for a work roll, adapted to press a rotating grinding wheel having elasticity against a work roll of a rolling mill to grind the work roll, characterized in that when a pressing load of the rotating grinding wheel reaches a set load F, which has been set beforehand at a value which is lower than a set grinding pressing load $F_0$, after the rotating grinding wheel contacts the work roll, a forward velocity of the rotating grinding wheel is reduced to decrease an overshoot by which the pressing load of the rotating grinding wheel on the work roll exceeds the set grinding pressing load $F_0$, characterized in that the load F which has been set beforehand has a value in a range satisfying the following equation (A):

$$F \leqq F_0 - K \times V1 \times \Delta t \quad \text{(A)}$$

where

F: set load [N], $F_0$: set grinding pressing load [N],

K: grinding wheel spring rigidity [N/mm],

V1: forward velocity [mm/s] of grinding wheel before velocity reduction, and Δt: control delay time [s], characterized in that a forward velocity V2 of the rotating grinding wheel after velocity reduction satisfies the following equation (B):

$$0.6 \times (S \times F_0/(K \times \Delta t)) V2 \leqq S \times F_0/(K \times \Delta t) \quad \text{(B)}$$

where

V2: forward velocity [minis] of rotating grinding wheel after velocity reduction, S: ratio of allowable overshoot amount to set grinding pressing load $F_0$, K: grinding wheel spring rigidity [N/mm], and Δt: control delay time [s].

* * * * *